United States Patent [19]

Zahn et al.

[11] Patent Number: 4,987,425

[45] Date of Patent: Jan. 22, 1991

[54] ANTENNA SUPPORT STRUCTURE

[75] Inventors: Rudolf Zahn, Markdorf; Hans W. Schroeder; Christian Borgwardt, both of Immenstaad; Albert Braig, Markdorf; Gunter Helwig, Daisendorf; Kay Dittrich, Meersburg, all of Fed. Rep. of Germany

[73] Assignee: Dornier System GmbH, Friedrichshafen, Fed. Rep. of Germany

[21] Appl. No.: 271,037

[22] Filed: Nov. 14, 1988

[30] Foreign Application Priority Data

Nov. 13, 1987 [DE] Fed. Rep. of Germany ..... 3738506

[51] Int. Cl.[5] ..... H01Q 21/000; H01Q 1/280; H01Q 1/320; H01Q 13/080

[52] U.S. Cl. ..... 343/853; 361/386; 361/388; 343/700 MS; 343/702; 343/705

[58] Field of Search ..... 343/700 MS, 705, 720, 343/872, 873, DIG. 2, 878, 879, 702; 361/388, 386, 424; 357/80, 81

[56] References Cited

U.S. PATENT DOCUMENTS 4,396,936 8/1983 McIver et al. ..... 357/80
4,628,407 12/1986 August et al. ..... 361/388
4,682,269 7/1987 Pitasi ..... 361/388
4,763,225 9/1988 Frenket et al. ..... 361/388
4,771,294 9/1988 Wasilousky ..... 343/853

FOREIGN PATENT DOCUMENTS 0010806 1/1985 Japan .

OTHER PUBLICATIONS

Fong, K. S. et al., Wideband Multilayer Coaxial-Fed Microstrip Antenna Element, Electronics Letters, vol. 21, No. 11, May, 1985.

Kanda, M. et al., The Characteristics of IsriFed MM wave Rect. M.S. Patch Antennas, IEEE Transactions on Electromagnetic Compatibility, vol. EMC-27, No. 4, Nov. 1985.

Kinzel, J. A. et al., V. Band, Space-Based Phased Array, Microwave Journal, Jan. 1987.

*Primary Examiner*—Rolf Hille
*Assistant Examiner*—Peter Toby Brown
*Attorney, Agent, or Firm*—Ralf H. Siegemund

[57] ABSTRACT

Carrying structure of an active antenna in the aerospace industry uses basically fiber reinforced synthetic material in which heat conductive elements and/or elements conducting electromagnetic waves (electro, optic) are integrated into that support structure for the antenna.

11 Claims, 2 Drawing Sheets

ANTENNA SUPPORT STRUCTURE

BACKGROUND OF THE INVENTION

The present invention relates to an integrating carrying structure for an antenna, particularly for application in the aircraft industry as well as for use in space vehicles i.e., in the aerospace industry; and here particularly the invention pertains to an antenna support structure of the active microwave type and being made of fiber-reinforced synthetic.

The aircraft industry as well as space vehicle application are fields in which weight of any component and of any part that is used is an important factor. In these fields of course it is also required that the stability and the dimensional integrity remain constant. This means that in the case of an antenna, the antenna must be capable of taking up aerodynamic loads, accelerations on take-off, launching or the like. Specifically, such an antenna has to remain stable with regard to any tendency toward deformation, for example, on account of low frequency oscillation or on account of thermal loads particularly as they may occur in outer space with very heavy solar radiation.

DESCRIPTION OF THE INVENTION

It is an object of the present invention to provide a new and improved, fiber-reinforced carrying structure permitting the establishing of a dimensionally stable antenna and antenna support structure, particularly an active antenna which is lighter and more stable than those known in the prior art.

In accordance with the preferred embodiment of the present invention it is suggested to integrate heat conductive elements and/or elements conducting electromagnetic waves into the carrying structure as it is being employed. More specifically it is suggested to provide, as a carrying structure, elements and structure such that thermal conductive elements and/or electromagnetically wave conductive elements are integrated in the carrying structure, or even establish the same.

Herein the heat conductive elements are made of metal or of a carbon fiber compound material such as P100 and in between are deposited heat emitting components which are preferably distributed over the entire area and are disposed on the outside of the antenna or the entire structure is made of a heat conductive material. Wave conductive elements are wire strips, cable etc. mounted on non-conductive structure parts.

Integration of heat conductive layers into the carrying structure can be carried out in that heat conductive layers are realized by fiber reinforced material such as CFK and are integrated in the carrying structure or they form by themselves this structure. The previously used heat removing elements such as heat pipes, Doppler sheets, radiating surface and so forth can be dispensed thereby saves weight. Owing to wide stiffening bars and the like and further on account of long fibers, heat conduction is increased. A distribution of hot parts over the entire antenna surface enhances radiation at a relatively uniform temperature. Owing to a coating on the antenna made of a thermal lacquer, one can increase the heat exchange within cavities as established between bars and support structure.

The integration of elements which conduct electromagnetic waves may refer specifically to the field of low frequency currents. An example here are the feeder currents and feeder lines. They are realized as conductive wires or strips in or on the structures made of nonconductive synthetic material. An advantage here is the avoidance of additional weights owing to the elimination of insulation and connecting elements because the structure in which these conductors are embedded provides already for this function.

The integration can be carried out in that the entire carrying structure is constructed as a set of electronic components. This can be realized in that the relevant structure is made of nonconductive high power (strength) fibers such as silicon carbide, aramide, or PE. Conductor strips and fastening of elements can be carried out in the usual manner. An advantage here is space economizing because additional carrying structure is not needed.

Another example for realizing the inventive integration is the insertion of high frequency conductive structures into the carrying structure. For example, signal conductors may be embedded into a CFK structure including the insulating cover. The insulation in this case is carried out for example as co-carying elements; using fibers which mechanically enhance the structure but are not conductive.

The inventive construction moreover may be realized through a hollow waveguide or the like. If the shielding effect of the CFK itself is insufficient, then the field isolation may be carried out through metal fibers of high-frequency conductivity. These fibers may be constructed as carrying components.

Another example for integration is the insertion of a houseless structure such as a transmitter and a receiver into a cabinet which is established by the structure itself. The inside of the cabinet is coated by a very thin metal coating for example 10 micrometers thick layer of gold. Again the result is a saving in weight.

Integration of elements conducting electromagnetic waves can of course also cover optical waves. In this case, glass fiber cables are no longer needed as separate optical elements. In accordance with the invention, this feature is realized by embedding signal transmitting glass fibers in a structure which, in turn, is composed of fiber reinforced synthetic. This feature can be facilitated further by working the glass fibers in rovings or in a mesh of load carrying fibers. This may lead to an elimination of that portion of the weight which otherwise was needed for enveloping the glass fiber cables themselves.

The integration may in fact be carried so far that entire high frequency components are integrated into and become a part of the load carrying structure itself. For example, a microstrip antenna may, in its entirety, be integrated into the structure as a top configuration. Antennas of this type are shown in copending application Ser. No. 271,036 filed: 11/14/1988. In this case, the microstrip or antenna dielectric material is made of a fiber reinforced synthetic of high strength, and having high stiffness, this construction is realizable for example by the use of polyethylene fiber reinforced polyethylene and even on the outside of a self carrying hollow.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding to the detailed description of the drawings, FIG. 1 illustrates an antenna for the synthetic aperture radar technology SAR including a carrier 4. The antenna specifically is comprised of an outer layer antenna 1 with radiating element in terms of patches 10 or an electrically insulating substrate 2 with a dielectric constant of epsilon R equal approximately to unity. Feeder strips 11 and 12 are integrated into the substrate 2. There is provided an electrically conductive base plate 3. The electrical connection between the radiating elements 10 and the feeder 12 may be provided through a local increase of the dielectric constant in zone 2*a* of the substrate 2, particularly in the area of these two elements 10 and 12.

Figure 1:
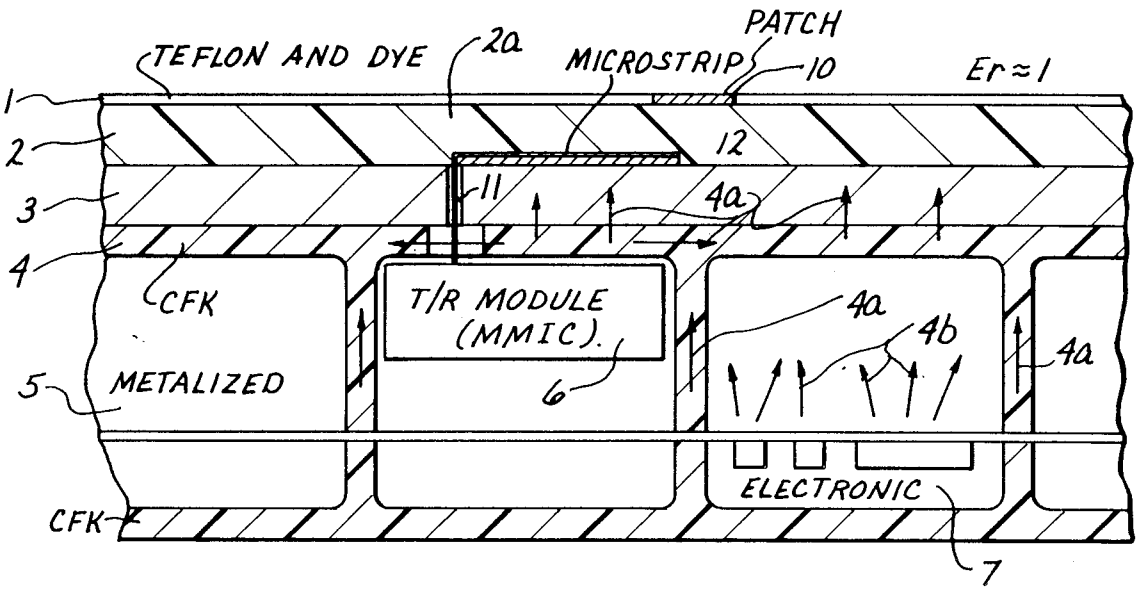
FIG. 1 is a cross section through an antenna structure in accordance with the preferred embodiment of the present invention.

The carrying structure 4 itself is of a box type construction, realized with many hollow spaces 5 bounded laterally by stiffening structures. Electrical modules such as 6 and electronic equipment carrier plates 7 may be included in these hollows 5. The carrying structure 4 is provided by and through carbon fiber reinforced synthetic material. The structure as a whole is metalized in order to obtain electric shielding.

All heat issuing parts such as the electrical module 6 and the electronic carrying plate 7 are preferably distributed over the entire antenna surface and are connected to the carrier 4 in a heat conductive relationship leading to the antenna surface. The arrows 4*a* shown in stiffening elements of structure 4 illustrate the heat flow through the carrier material made of heat conductive synthetic. Arrows 4*b* show radiation inside a hollow cavity 5 from a part carrier 7.

Figure 2:
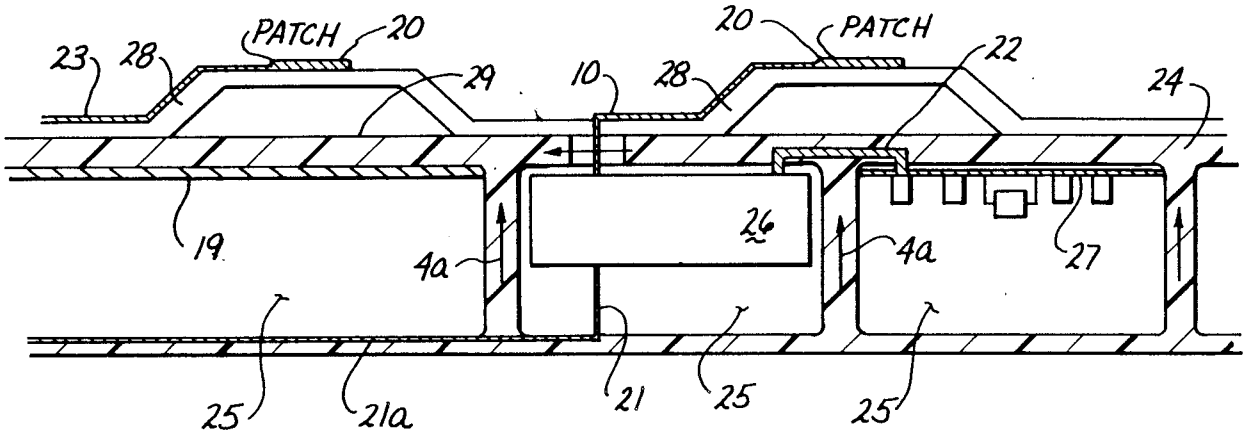
FIG. 2 is a cross section through another, load carrying structure involving a microstrip antenna.

FIG. 2 illustrates a configuration of integrating elements into the hollow support structure and carrier 24, which elements conduct electromagnetic waves. The structure may be comprised of CFK being metalized (29) on the surface that carries the antenna body 28. This body is provided on the outside of the structure 24. This antenna body substrate 28 is provided with a substrate thicknesses in the area of a few mm and has elevations in the mm range as type as shown in copending application Ser. No. 271,036, filed: 11/14/1988.

Electronic modules and printed circuit elements 27 are arranged inside hollows 25 of the support structure 24. A phase shift network 19 is likewise integrated in the structure 24. This network 19 is arranged in each instance under the individual radiating element or patch 20 of the group antenna 28. The microstrips 23 leading to the patches 20 are also integrated into the structure.

An electric conductor 22 is integrated in the structure leading to the module 26 and printed circuit plate 27. A glass fiber 21*a* connects the electrical modules 26 for purposes of signal conduction with central electronic equipment outside of the area of illustration. Conductor 21 is shown as a discrete element for a short distance, and runs then as a glass fiber 21*a* in the support structure 24 in an integrated fashion as indicated by the thicker line. The arrows 4*a* inside structure 24 again indicate the direction of heat conduction.

The invention is not limited to the embodiments described above but all changes and modifications thereof, not constituting departures from the spirit and scope of the invention, are intended to be included.

We claim:

1. Carrying structure of an active antenna in the aerospace industry using basically fiber reinforced synthetic material, the improvement comprising;

a carrier of hollow construction and made of heat conductive elements there being heat producing and heat yielding electronic components mounted on surfaces in an interior of the hollow construction;

stiffening elements being parts of the heat conductive hollow construction; and solid means including the stiffening elements being provided for conducting heat from said components to a front face of the hollow construction on which are mounted antenna elements so that heat is dissipated through the same surface on which the antenna elements are mounted.

2. Carrying structure as in claim 1, the heat conductive elements being metal arranged between the heat yielding components and the exterior of the hollow construction.

3. Carrying structure as in claim 1, the heat conductive elements being fiber material.

4. Structure as in claim 3, said heat conductive elements being made of carbon fiber material.

5. Structure as in claim 1 and further including a structure of nonconductive material including a plate mounted in the hollow construction of the carrier and being provided for conducting low frequency current and electomagnetic wave conducting elements including at least one of the following; wires, strips, microstrips, fibers, cables and conductors, said wave conducting elements being arranged in physically contacting relation to the structure of nonconductive material of the carrier.

6. Structure as in claim 1, further including electromagnetic wave conducting elements provided for conducting high frequency currents including at least one of the following; coaxial cable*, waveguides, and electrically shielded high frequency components, the wave conducting elements being mounted on the hollow construction of the carrier.

7. Structure as in claim 1 further including electromagnetic wave conductor elements mounted on the carrier and being light conducting fibers arranged as signal lines between otpical or optoelectronic components within the hollow construction of the carrier.

8. An antenna structure comprising:

a carrier made of insulating fiber reinforced material with hollow spaces in its interior and having in the interior, a carrying surface, the hollow space including stiffening side walls provided for strengthening the carrier;

electric power circuit elements in the interior of said hollow spaces in heat conductive relation with the carrier material such that the heat developed by the circuit elements is conducted through said stiffening side walls to the said carrying surface;

a protective layer on the carrier in heat conductive relation thereto such that heat from the carrier is radiated off a front surface of the protective layer;

antenna elements mounted on said front surface of the protective layer such that heat is also conducted through said antenna elements; and feeder lines connected to the antenna elements and embedded in the protective layer between the carrier and the antenna elements.

9. Structure as in claim 8, said feeder lines being capacitively connected to the antenna elements.

10. An antenna structure comprising;

a basically hollow carrier made of solid, fiber reinforced wall structure which surrounds hollow spaces of the hollow carrier;

electromagnetic wave conducting means mounted in heat conductive relation to the wall structure of the hollow carrier and becoming therewith an integral part of the hollow carrier;

electrical components of the antenna mounted in said hollow spaces to conduct heat into the wall structure and being further connected to said electromagnetic wave conducting means; and antenna elements on one of the surfaces of said hollow carrier, thus being a mounting surface, and connectors being disposed on said mounting surface, the wall structure of the hollow carrier conducting heat to said antenna element mounting surface.

11. Structure as in claim 10, the antenna elements being on an insulating substrate that has portions being shaped for locally increasing the distance of the antenna elements from the carrier.

* * * * *